US009288845B2

(12) United States Patent
Yamamoto

(10) Patent No.: US 9,288,845 B2
(45) Date of Patent: Mar. 15, 2016

(54) CERAMIC HEATER

(75) Inventor: Ken Yamamoto, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 67 days.

(21) Appl. No.: 13/126,457

(22) PCT Filed: Oct. 20, 2009

(86) PCT No.: PCT/JP2009/068046

§ 371 (c)(1),
(2), (4) Date: Jun. 28, 2011

(87) PCT Pub. No.: WO2010/050380

PCT Pub. Date: May 6, 2010

(65) Prior Publication Data

US 2011/0253704 A1 Oct. 20, 2011

(30) Foreign Application Priority Data

Oct. 28, 2008 (JP) ..... 2008-276379

(51) Int. Cl.
*H05B 3/02* (2006.01)
*H05B 3/48* (2006.01)
*F23Q 7/00* (2006.01)

(52) U.S. Cl.
CPC *H05B 3/48* (2013.01); *F23Q 7/001* (2013.01); *H05B 2203/027* (2013.01)

(58) Field of Classification Search
CPC ..... F23Q 7/001; H05B 3/141
USPC ..... 219/270, 544; 123/145 A
See application file for complete search history.

(56) References Cited

U.S. PATENT DOCUMENTS 4,502,430 A * 3/1985 Yokoi et al. ..... 123/145 A
5,750,958 A * 5/1998 Okuda et al. ..... 219/267
6,653,601 B2 * 11/2003 Taniguchi et al. ..... 219/270
7,223,942 B2 * 5/2007 Konishi et al. ..... 219/270
7,351,935 B2 * 4/2008 Konishi ..... 219/270

(Continued)

FOREIGN PATENT DOCUMENTS

CN 1650671 A 8/2005
CN 2857398 Y 1/2007

(Continued)

OTHER PUBLICATIONS

Chinese language office action dated Aug. 5, 2013 and its English language Statement of Relevance of Non-English References Pursuant to 37 CFR 1.98(a)(3)(i) issued in corresponding Chinese Patent Application No. 200980142507.8.

(Continued)

*Primary Examiner* — Thien S Tran
(74) *Attorney, Agent, or Firm* — Volpe and Koenig, P.C.

(57) ABSTRACT

A ceramic heater is constructed by embedding a heat-generator in a base body made of ceramics. The heat-generator has a recess in a surface thereof, the ceramics being inside the recess. Even if a great thermal stress is developed due to a difference in thermal expansion between the heat-generator and the base body, by the recess inside which the ceramics that forms the base body exists, occurrence of a gap between the heat-generator and the base body, as well as appearance of cracks in the base body, can be prevented even in the direction of the length of the heat-generator in which the thermal stress is applied heavily.

5 Claims, 4 Drawing Sheets

(56) References Cited

U.S. PATENT DOCUMENTS

| | | | | |
|---|---|---|---|---|
| 7,705,273 | B2 | 4/2010 | Hotta et al. | |
| 2002/0036192 | A1 | 3/2002 | Sato et al. | |
| 2002/0162831 | A1* | 11/2002 | Taniguchi et al. | 219/270 |
| 2002/0175156 | A1* | 11/2002 | Hotta et al. | 219/270 |
| 2005/0274707 | A1 | 12/2005 | Matsubara et al. | |
| 2007/0210053 | A1* | 9/2007 | Hotta et al. | 219/270 |
| 2009/0194519 | A1 | 8/2009 | Funaki et al. | 219/270 |

FOREIGN PATENT DOCUMENTS

| | | | |
|---|---|---|---|
| CN | 1942709 | A | 4/2007 |
| JP | 62-044975 | | 2/1987 |
| JP | 62-044975 | A | 2/1987 |
| JP | 06-140133 | A | 5/1994 |
| JP | H07006865 | A | 1/1995 |
| JP | 10110951 | A | 4/1998 |
| JP | 2000-220829 | A | 8/2000 |
| JP | 3351573 | B2 | 9/2002 |
| JP | 3351573 | B2 | 11/2003 |
| JP | 2005-299945 | A | 10/2005 |
| JP | 2007-335397 | | 12/2007 |
| WO | WO 2008105327 | A1 * | 9/2008 |

OTHER PUBLICATIONS

Chinese language office action dated Feb. 12, 2014 and its English language concise explanation issued in corresponding Chinese application 200980142507.8.

Extended European search report dated Jul. 11, 2014 issued in corresponding European application 09823492.5.

Korean Office Action with English concise explanation, Korean Patent Application No. 10-2011-7009652, Jul. 21, 2015, 4 pgs.

Japanese Office Action with English concise explanation, Japanese Patent Application No. 2008-276379, Jan. 22, 2013, 5 pgs.

Japanese Information Offer Form, Japanese Patent Application No. 2008-276379, Sep. 8, 2011, 4 pgs.

* cited by examiner

CERAMIC HEATER

CROSS-REFERENCE TO THE RELATED APPLICATIONS

This application is a national stage of international application No. PCT/JP2009/068046, filed on Oct. 20, 2009, and claims the benefit of priority under 35 USC 119 to Japanese Patent Application No. 2008-276379, filed on Oct. 28, 2008, the entire contents of which are incorporated herein by reference.

TECHNICAL FIELD

The present invention relates to a ceramic heater.

BACKGROUND ART

Ceramic heaters have been used to date for various applications, including an ignition heater of an oil fan heater and a glow plug for use in assistance to the starting of diesel engine operation. For example, such a ceramic heater is constructed by embedding a heat-generator made of electrically conductive ceramics in a base body made of insulating ceramics. In constructing the ceramic heater, as a material used to form the heat-generator, there has been known a substance composed predominantly of at least one of a suicide of molybdenum, tungsten, or the like, a nitride thereof, and a carbide thereof. Moreover, as a material used to form the base body, there has been known a substance composed predominantly of silicon nitride.

However, in general, the material which forms the heat-generator is greater in thermal expansion coefficient than the material which forms the base body. Accordingly, there is a possibility that cracks appear in the base body due to a thermal stress arising between the two materials at a time of heat generation. In view of this, there has been proposed a technique that a rare-earth component, a silicide of chromium, and an aluminum component are contained in the base body, in order to reduce the difference in thermal expansion coefficient between the two materials (refer to Patent Literature 1, for example).

CITATION LIST

Patent Literature

Patent Literature 1: Japanese Unexamined Patent Publication JP-A 2007-335397

DISCLOSURE OF INVENTION

Technical Problem

However, in the conventional ceramic heater as described above, even if a difference in thermal expansion coefficient between the heat-generator and the base body can be reduced, when the flow of a large current takes place under abnormal conditions, a great thermal stress is developed. This gives rise to the problem to be solved of breakage of the base body.

The invention has been devised to overcome such a problem associated with the conventional ceramic heater as mentioned above, and an object thereof is to provide a highly durable ceramic heater that is capable of suppressing appearance of cracks or occurrence of breakage in a base body resulting from a difference in thermal expansion between the ceramic-made base body and a heat-generator.

Solution to Problem

A ceramic heater of the invention comprises a base body made of ceramics; and a heat-generator embedded in the base body, wherein the heat-generator comprises a recess in a surface thereof, the ceramics being inside the recess.

In the ceramic heater of the invention, it is preferable that the recess is located in a maximum heat-generating portion of the heat-generator. Moreover, it is preferable that the recess is located in the surface of the heat-generator which faces a surface of the base body. Further, it is preferable that the heat-generator comprises the recess in a plurality.

Advantageous Effects of Invention

According to the ceramic heater of the invention,. the heat-generator has a recess in a surface thereof, the ceramics being inside the recess. In this construction, the ceramics which is inside the recess of the heat-generator serves as a support column for securing the intimate contact with the heat-generator, thereby producing an anchor effect between the base body and the heat-generator. Therefore, even if the flow of a large current takes place under abnormal conditions with consequent development of a great thermal stress due to the difference in thermal expansion between the heat-generator and the ceramic-made base body, occurrence of a gap between the heat-generator and the base body can be suppressed even in the direction of the length of the heat-generator in which the thermal stress is applied heavily. This makes it possible to prevent occurrence of cracks in the base body, as well as occurrence of breakage and scattering in the front end of the heater.

Moreover, in a case where the recess is located in a maximum heat-generating portion of the heat-generator, the volume of the ceramic-made base body existing around the maximum heat-generating portion is increased by an amount equal to the recess. This makes it possible to increase a high-temperature strength during voltage application, and thereby increase durability to withstand vibration.

Further, in a case where the recess is located in the surface of the heat-generator which faces a surface of the base body, the distance from the recess to the surface of the base body with respect to the circumferential direction comes close to a distance from a recess-free part of the heat-generator to the surface of the base body. Accordingly, the circumferential temperature distribution in the heater can be rendered uniform.

Further, in a case where the heat-generator has the recess in a plurality, each of the recesses serves as a support column for securing the intimate contact with the heat-generator, and there are provided an increased number of the support columns. This makes it possible to provide an anchor effect between the base body and the heat-generator more effectively. Therefore, even if the flow of a large current takes place under abnormal conditions with consequent development of a great thermal stress due to the difference in thermal expansion between the heat-generator and the ceramic-made base body, occurrence of a gap between the heat-generator and the base body can be suppressed even in the direction of the length of the heat-generator in which the thermal stress is applied heavily. This makes it possible to prevent occurrence of cracks in the base body, as well as occurrence of breakage and scattering in the front end of the heater.

BEST MODE FOR CARRYING OUT THE INVENTION

Hereinafter, embodiments of a ceramic heater according to the invention will be described in detail with reference to the drawings.

Figure 1:
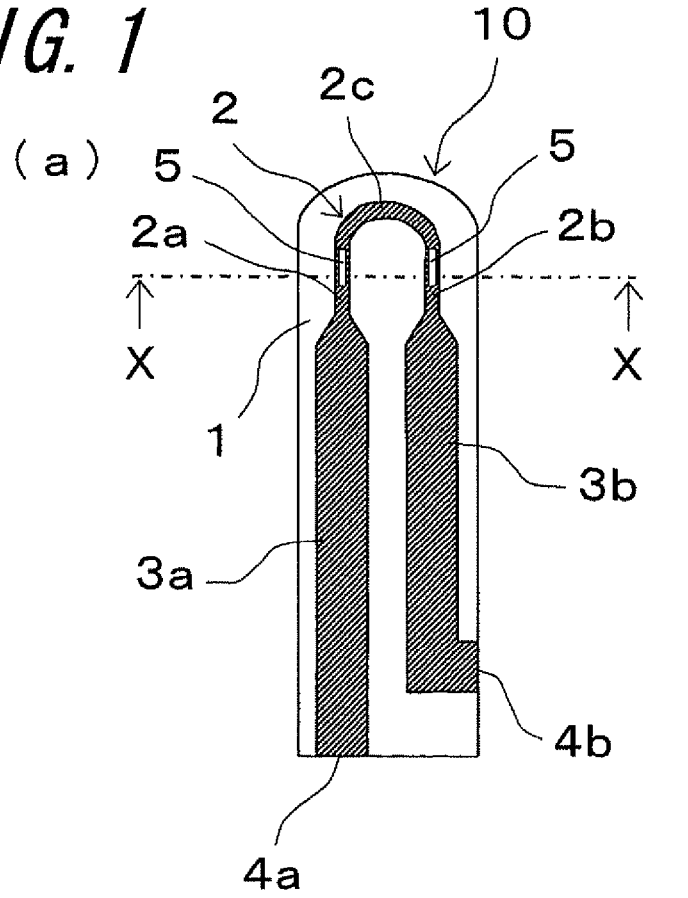
FIG. 1(*a*) is a plan view showing transparently an example of an inside of a ceramic heater according to an embodiment of the invention, and FIG. 1(*b*) is an enlarged view showing a main part of the ceramic heater.
Figure 1:
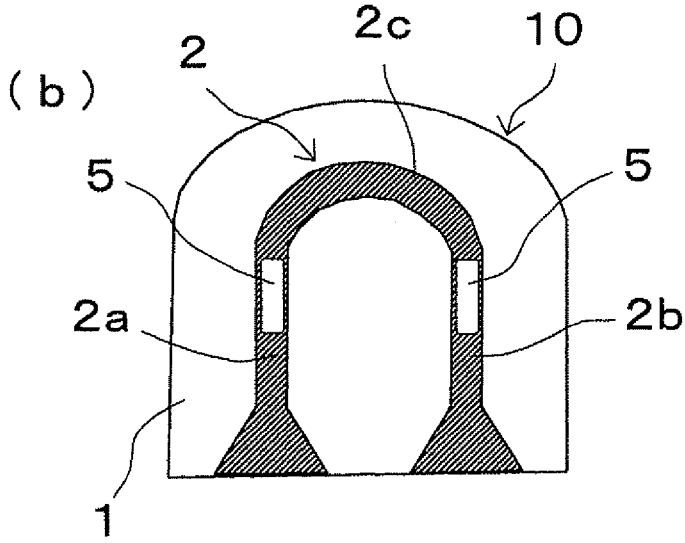

FIG. 1(*a*) is a plan view showing transparently an example of an inside of a ceramic heater according to an embodiment of the invention, and FIG. 1(*b*) is an enlarged view showing a main part of the ceramic heater. It is noted that a heat-generator 2 depicted transparently in FIG. 1 is hatched. Moreover, FIG. 2 is a sectional view taken along the line X-X shown in FIG. 1.

A ceramic heater 10 of this embodiment comprises a base body 1 made of ceramics; a heat-generator 2 embedded in the base body 1, which includes two opposed portions 2*a* and 2*b* arranged in juxtaposition and a connection portion 2*c* for connecting the two portions together in arcuate form; and a pair of lead portions 3*a* and 3*b* that are connected to the opposite ends, respectively, of the heat-generator 2. In the heat-generator 2, the two opposed portions 2*a* and 2*b* arranged side by side in the base body 1 and the arcuately shaped connection portion 2*c* connecting the two portions together define a U-shape. An electric current is fed through the heat-generator 2 via the lead portions 3*a* and 3*b*, whereupon heat is liberated from the heat-generator 2.

In this embodiment, the lead portions 3*a* and 3*b* are made of the same material as that used for the heat-generator 2, are formed so as to merge with the two opposed portions 2*a* and 2*b*, respectively, while extending in substantially the same direction, are made larger in diameter than the heat-generator 2, and are made lower in resistance per unit length than the heat-generator 2 to suppress unnecessary heat generation. An end face of the lead portion 3*a* opposite the end face thereof merging with the portion 2*a* of the heat-generator 2, is exposed at an end face of the base body 1, thereby constituting an electrode-taking portion 4*a*. Moreover, an end face of the lead portion 3*b* opposite the end face thereof merging with the portion 2*b* of the heat-generator 2, is exposed at a lateral face of the base body 1, thereby constituting an electrode-taking portion 4*b*.

Figure 2:
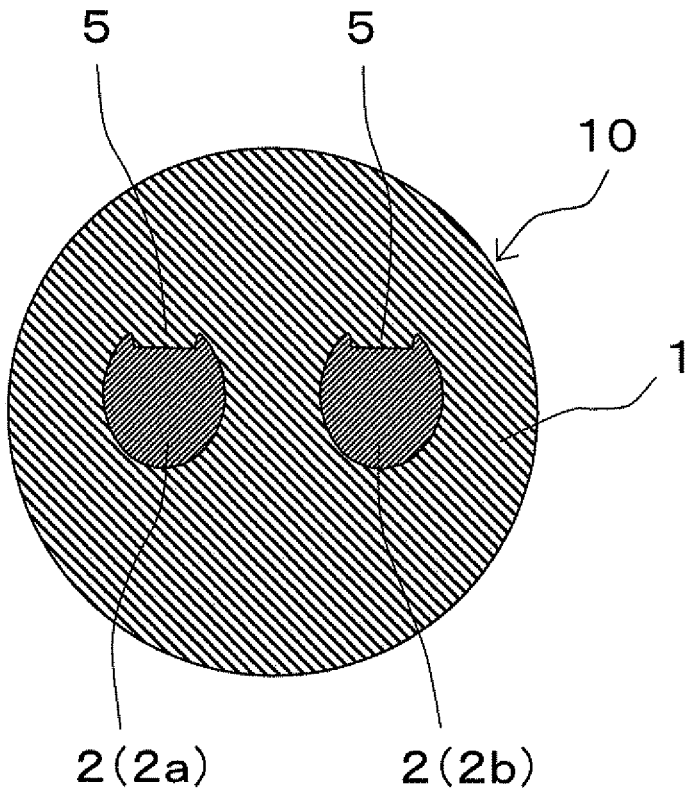
FIG. 2 is a sectional view taken along the line X-X shown in FIG. 1.

FIG. 2 is a sectional view of the ceramic heater 10 taken along the line X-X shown in FIG. 1. As shown in FIG. 2, a recess 5 inside which a ceramic material that forms the base body 1 exists, is located in the heat-generator 2 of the ceramic heater 10. Thus, in contrast to the conventional ceramic heater free of the recess 5 inside which the ceramic material that forms the base body 1 exists, in the ceramic heater 10 of the invention, even if abnormal conditions are encountered, for example, even if the flow of a large current takes place immediately after the start-up of operation, since the recess 5 of the heat-generator 2 inside which the ceramic material that forms the base body 1 exists, is present between the different materials; that is, the heat-generator 2 and the base body 1, it follows that an anchor effect can be produced between them. This makes it possible to prevent development of a gap between the heat-generator 2 and the base body 1, as well as appearance of cracks in the base body 1, especially in the direction of the length of the heat-generator 2, resulting from the difference in instantaneous thermal expansion between the heat-generator 2 and the base body 1.

The recess 5 in question is located in one or more of the opposed portions 2*a* and 2*b* and the connection portion 2*c* of the heat-generator 2 so as to lie on the surface thereof. In the interest of attainment of the anchor effect, the depth of the recess 5 is desirably greater than or equal to 5% of the diameter of the heat-generator 2 (2*a*, 2*b*, 2*c*) (or, when the heat-generator 2 has an elliptic cross section, the major axis of the ellipse) in which the recess 5 is located. Meanwhile, in the interest of prevention of localized heat generation in the heat-generator 2, the depth of the recess 5 is desirably less than or equal to 30% of the diameter (the major axis) of the heat-generator 2.

Moreover, the dimension of the recess 5 in the direction of the length of the heat-generator 2 is desirably greater than or equal to 1/10, but less than or equal to ½, of the length of the opposed portions 2*a* and 2*b* or the connection portion 2*c* of the heat-generator 2 in which the recess 5 is located in the interest of attainment of the anchor effect. Further, the dimension of the recess 5 in the direction of the width of the heat-generator 2 is desirably greater than or equal to 1/10, but less than or equal to ½, of the width of the opposed portions 2*a* and 2*b* or the connection portion 2*c* of the heat-generator 2 in the interest of attainment of the anchor effect. For example, given that the heat-generator 2 has a circular cross section which is 1 mm in diameter, and the portion 2*a* thereof is 10 mm in length, then the recess 5 is shaped like a slot extending along the portion 2*a*, the depth of which desirably falls in the range of 50 μm or more and 300 μm or less, the length of which desirably falls in the range of 1 mm or more and 5 mm or less, and the width of which desirably falls in the range of 100 μm or more and 500 μm or less.

Moreover, there is no particular limitation to the location of formation of the recess 5 in the heat-generator 2, and it may therefore be located in any given part of the heat-generator 2 so long as greater durability can be ensured in accordance with the specifications of the ceramic heater 10. For example, a ceramic heater adapted to an ignition heater of an oil fan heater, a glow plug for use in assistance to the starting of diesel engine operation, and the like is generally used in the form of a ceramic-made base body having a maximum heat-generating portion at the front end thereof. It is therefore preferable to locate the recess 5 in a location spaced by 1 to 5 mm away from the front end of the heat-generator 2.

Moreover, although the recess 5 may be made in various shapes so long as it can be formed on the heat-generator 2, in most instances, the recess 5 is circular-shaped, oval-shaped, elliptically-shaped, or rectangular-shaped in a plan view. This renders possible easy formation of the recess 5 and attainment of advantageous effects.

Hereinafter, materials suitable for construction of the ceramic heater 10 of the invention will be described.

As the material of construction of the ceramic-made base body 1, alumina ceramics or silicon nitride ceramics is desirable for use because of its excellence in insulation property under high-temperature conditions. The use of silicon nitride ceramics is particularly desirable because of its high durability under rapid temperature rise. Silicon nitride ceramics has a composition based on bonding of main crystalline-phase grains composed predominantly of silicon nitride ($Si_3N_4$) via a grain boundary phase derived from a sintering aid component or the like.

The main crystalline phase may be obtained by substitution of silicon (Si) or nitrogen (Ni) in part for aluminum (Al) or oxygen (O), and may also contain metallic elements such as Li, Ca, Mg, and Y in the form of solid solution. The base body 1 of this embodiment can be molded by subjecting ceramic raw material powder, which is prepared by adding a sintering aid composed of rare-earth element oxide such as ytterbium (Yb), yttrium (Y), or erbium (Er) to silicon nitride powder, to a heretofore known press molding or the like, as in the case of formation of the heat-generator 2. It is noted that, in the interest of formation of the base body 1 having a desired shape, the base body 1 is preferably formed by means of injection molding that allows freedom of determination of the shape of a molded product in conformity with a mold.

As the material of construction of the heat-generator 2, a heretofore known electrically conductive ceramics in the form of a heat-generating resistor, such as tungsten carbide (WC), molybdenum disilicide ($MoSi_2$), and tungsten disilicide ($WSi_2$) can be used. By way of example, a case where tungsten carbide is used for the formation of the heat-generator 2 will be described below.

At first WC powder is prepared for use. The WC powder is preferably blended with insulating ceramics, such as silicon nitride ceramics which is the major constituent of the base body 1, for the reduction of the difference in thermal expansion coefficient between the heat-generator 2 and the ceramic-made base body 1. At this time, by making changes to the content ratio between the insulating ceramics and the conductive ceramics, the electrical resistance of the heat-generator 2 can be adjusted to a desired value. The heat-generator 2 can be obtained by molding ceramic raw material powder blended with silicon nitride ceramics which is the insulating ceramics used as the major constituent of the base body 1 by a heretofore known method such as press molding. It is noted that the heat-generator 2 is preferably formed by means of injection molding that allows freedom of determination of the shape of a molded product in conformity with a mold.

Hereinafter, an example of the method of manufacturing the heat-generator 2 of the ceramic heater 10 in accordance with one embodiment of the invention will be described.

Figure 3:
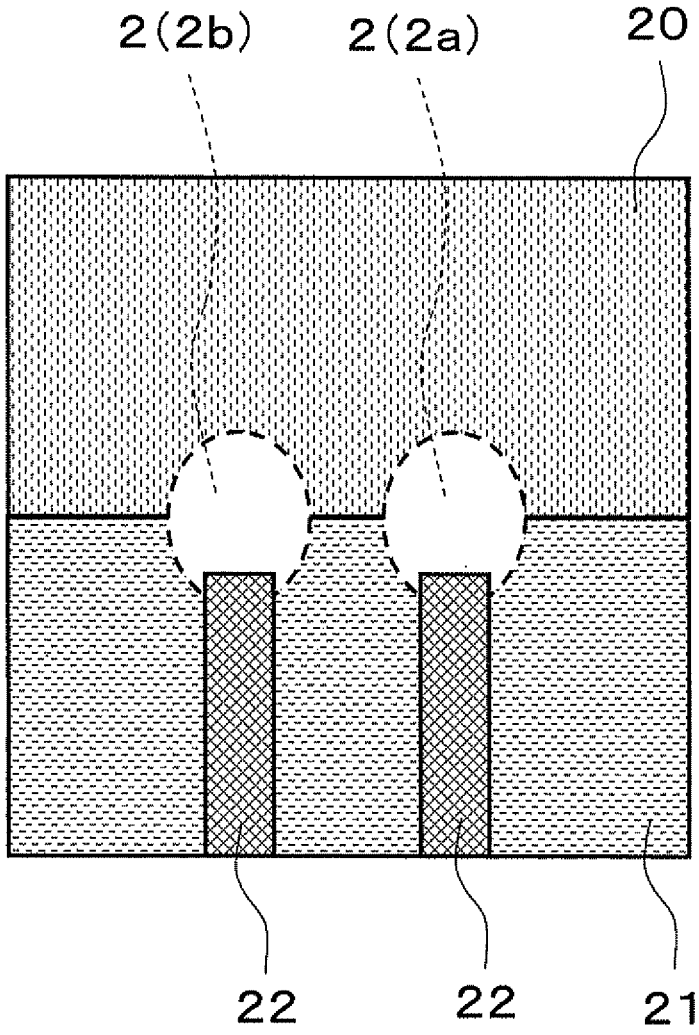
FIG. 3 is a sectional view showing an example of a mold used for forming a heat-generator of the ceramic heater according to the invention.

To begin with, a mold for forming the heat-generator 2 is prepared, exemplary of which is illustrated in cross section in FIG. 3. The mold is composed of an upper mold 20 and a lower mold 21. When the upper mold 20 and the lower mold 21 are combined together, a cavity which conforms to the shape of the heat-generator 2 (the opposed portions 2*a* and 2*b* in FIG. 3) is created. In order to form the recess 5 in the heat-generator 2 with use of such a mold, a recess forming pin 22 is disposed inside the mold body of the lower mold 21. It is noted that, in addition to being disposed inside the mold body of the lower mold 21, the recess forming pin 22 may also be disposed so as to pass through the upper mold 20 and the lower mold 21 in a longitudinal or transverse direction, or disposed so as to be held between the mating surfaces of the upper mold 20 and the lower mold 21, so long as it extends into the cavity.

By disposing the recess forming pin 22 as a pin which extends into the cavity for free insertion and extraction, the recess 5 conforming to the shape of the front end of the recess forming pin 22 can be formed, from any given direction, on the surface of the heat-generator 2 constructed by charging the corresponding material into the cavity. Moreover, with flexibility in the determination of the dimension of the recess forming pin 2, the size of the recess 5 can be determined without restraint. Further, with flexibility in the determination of the length of the recess forming pin 2, the depth of the recess 5 can be determined without restraint.

The molded product of the heat-generator 2, which has been formed by means of injection molding using such a mold (the upper mold 20 and the lower mold 21), is combined with the molded products of the lead portions 3*a* and 3*b* formed by using another mold. The resulting combination is further combined with, and more specifically embedded in the molded product of the base body 1 formed by using still another mold, thereby forming a green molded product of the ceramic heater 10.

The green molded product thereby obtained is fired in accordance with a predetermined temperature profile so as to become the base body 1 having the heat-generator 2 and the lead portions 3*a* and 3*b* embedded therein. The resulting sintered product is subjected to machining process on an as needed basis. As a result, the ceramic heater 10 of this embodiment as shown in FIG. 1 is completed. Where the method of firing is concerned, in the case of using silicon nitride ceramics as the ceramics that forms the base body 1, for example, a hot press method can be adopted that involves a step of degreasing treatment and a step of firing under a reduction atmosphere in conditions of a temperature of about 1650 to 1780° C. and a pressure of about 30 to 50 MPa.

According to the ceramic heater 10 of this embodiment, the heat-generator 2 embedded in the base body 1 made of ceramics has the recess 5 in its surface, the ceramic material that forms the base body 1 being inside the recess 5. In contrast to the conventional ceramic heater free of the recess 5 inside which the ceramic material that forms the base body 1 exists, in this ceramic heater 10, even if abnormal conditions are encountered, for example, even if the flow of a large current takes place immediately after the start-up of operation, since the recess 5 of the heat-generator 2 inside which the ceramics that forms the base body 1 exists, is present between the different materials; that is, the heat-generator 2 and the ceramic-made base body 1, it follows that an anchor effect can be produced between the two different materials. This makes it possible to prevent development of a gap between the heat-generator 2 and the base body 1, as well as appearance of cracks in the base body 1, especially in the direction of the length of the heat-generator 2, resulting from the difference in instantaneous thermal expansion between the heat-generator 2 and the base body 1.

The recess 5 formed in the heat-generator 2 is desirably located in a maximum heat-generating portion of the heat-generator 2, which maximum heat-generating portion is a part which produces heat at the highest temperature when electric current is passed through the ceramic heater 10. In this case, the ceramics that forms the base body 1, the volume of which increases as the heat-generator 2 produces heat, undergoes maximum increase in volume at a part thereof which lies in the recess 5 existing in the maximum heat-generating portion of the heat-generator 2. This makes it possible to provide an anchor effect between the heat-generator 2 and the base body 1 effectively by virtue of the recess 5, and thereby increase a high-temperature strength during voltage application. It is also possible to increase durability to withstand vibration or the like.

It is noted that the location and size of the maximum heat-generating portion of the heat-generator 2 vary according to the specifications of the heat-generator 2. Therefore, in the case of locating the recess 5 in the maximum heat-generating portion, it is advisable to determine the shape and dimension of the recess 5 properly in conformity with the location and size of the maximum heat-generating portion. In the maximum heat-generating portion, for example, when adopted in a glow plug for use in assistance to the starting of diesel engine operation, its temperature rises to about 1250° C. In an area spaced toward the lead portion 3*a*, 3*b* by a distance of about 2 mm from the maximum heat-generating portion, there is a temperature drop of about 100° C. It is advisable to design the recess 5 in view of this temperature difference.

Figure 4:
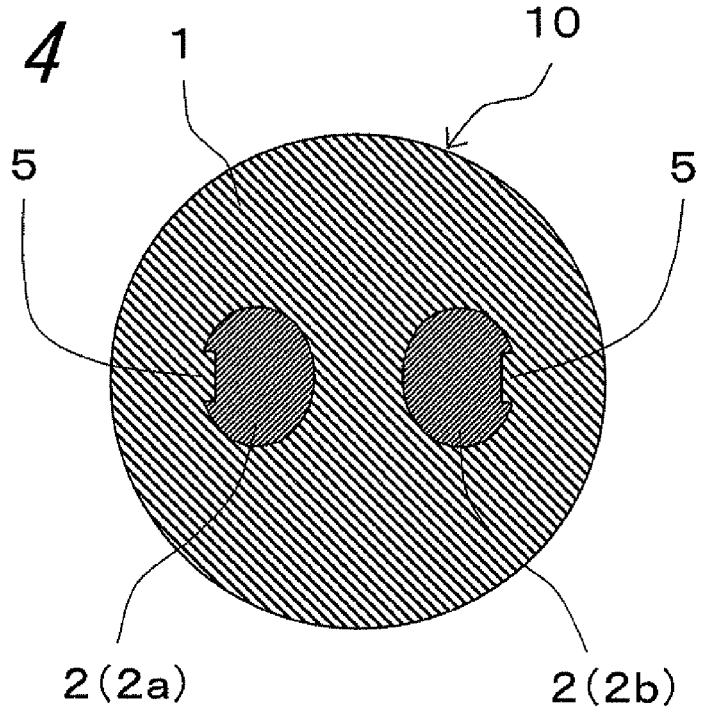
FIG. 4 is a sectional view of another embodiment of the ceramic heater according to the invention.

Moreover, in locating the recess 5 in the heat-generator 2, as illustrated in a sectional view of FIG. 4 similarly to FIG. 2, the recess 5 is desirably located in a part of the surface of the heat-generator 2 which faces a surface of the base body 1. In this case, even if abnormal conditions are encountered, for example, even if the flow of a large current takes place, since the recess 5 of the heat-generator 2 lies toward the surface of the base body 1; that is, a part of the ceramic-made base body 1 which undergoes greater thermal expansion than does the part situated between the opposed portions 2*a* and 2*b* of the heat-generator 2, it is possible to provide an anchor effect by virtue of the recess 5 more effectively. As a result, development of a gap between the heat-generator 2 and the base body 1, as well as appearance of cracks in the base body 1, can be prevented.

Moreover, the minimum distance from the recess 5 of the heat-generator 2 to the surface of the base body 1 comes close to the minimum distance from a recess-free part of the heat-generator 2 to the surface of the base body 1, with the consequence that the rate of heat conduction from the recess to the base body comes close to that from the recess-free part to the base body. Accordingly, the temperature distribution is likely to be uniform throughout the circumferential surface of the base body 1. This makes it possible to enhance the heating uniformity of the ceramic heater 10 and thereby reduce temperature variation.

As exemplary of the heat-generator 2 having the recess 5 formed on the surface thereof facing the surface of the base body 1, in FIG. 4, there is shown the heat-generator 2 in which the recess 5 is formed on each of the left-hand outer side and the right-hand outer side of the opposed portions 2*a* and 2*b*, respectively. Alternatively, the recess 5 may be formed in either an upper part or a lower part of the heat-generator 2. In another alternative, the location of formation of the recess 5 is not limited to the opposed portions 2*a* and 2*b*, but may be a front-end side, an upper side, or a lower side of the connection portion 2*c*.

Figure 5:
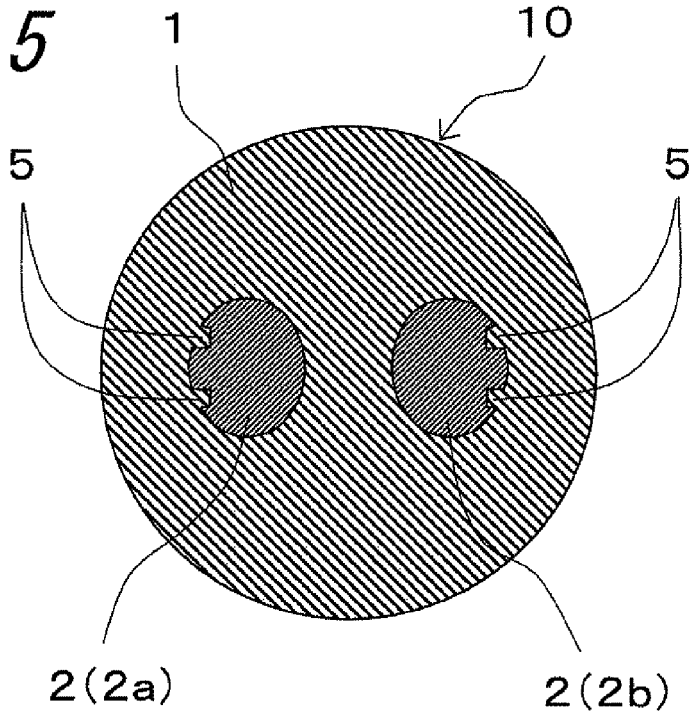
FIG. 5 is a sectional view of further another embodiment of the ceramic heater according to the invention.

Further, as illustrated in a sectional view of FIG. 5 similarly to FIG. 2, the heat-generator 2 desirably comprises the recess 5 in a plurality. In this case, between the different materials; that is, the heat-generator 2 and the ceramic-made base body 1, there exist a plurality of recesses 5, each of which is entered by the ceramics, formed on the surface of the heat-generator 2. Therefore, each of the recesses 5 serves to provide an anchor effect between the two different materials, with consequent production of a significant anchor effect as taken altogether. This makes it possible to prevent development of a gap between the heat-generator 2 and the base body 1, as well as appearance of cracks in the base body 1, in the direction of the length of the heat-generator 2, resulting from the difference in instantaneous thermal expansion between the heat-generator 2 and the base body 1 more effectively.

In such a case where the heat-generator 2 comprises a plurality of recesses 5, it is advisable that the recesses 5 are located in one or more of the opposed portions 2*a* and 2*b* and the connection portion 2*c* of the heat-generator 2 so as to lie on the surface thereof. In the interest of attainment of the anchor effect, the depth of the recess 5 is desirably greater than or equal to 5% of the diameter of the heat-generator 2 (2*a*, 2*b*, 2*c*) (or, when the heat-generator 2 has an elliptic cross section, the major axis of the ellipse) formed with the recess 5. Meanwhile, in the interest of prevention of localized heat generation in the heat-generator 2, the depth of the recess 5 is desirably less than or equal to 30% of the diameter (the major axis) of the heat-generator 2. Moreover, it is preferable that, in the direction of the length of the heat-generator 2, a plurality of recesses 5 having a lengthwise dimension of about 1/10 of the length of the opposed portions 2*a* and 2*b* or the connection portion 2*c* of the heat-generator 2 in which the recess 5 is located are provided, and more specifically about three to five recesses 5 are located within a region of less than or equal to ½ of the length thereof, in the interest of attainment of the anchor effect. Further, it is preferable that, in the direction of the width of the heat-generator 2, about two to four recesses 5 having a widthwise dimension of about 1/10 of the width of the opposed portions 2*a* and 2*b* or the connection portion 2*c* of the heat-generator 2 are located within a region of less than or equal to ½ of the width of the heat-generator 2 in the interest of attainment of the anchor effect.

For example, given that the heat-generator 2 has a circular cross section which is 1 mm in diameter and the portion 2*a* thereof is 10 mm in length, then it is preferable that the depth of the recess 5 falls in the range of 50 μm or more and 300 μm or less, and that, in the lengthwise direction, there are arranged three to five recesses 5 having a length of about 1 mm, and, in the widthwise direction, there are arranged two to four recesses 5 having a width of about 100 μm.

REFERENCE SIGNS LIST

1: Base body
2: Heat-generator
2*a*, 2*b*: Opposed portion
2*c*: Connection portion
3*a*, 3*b*: Lead portion
5: Recess

The invention claimed is:

1. A ceramic heater, comprising:
a heat-generator having at least one recess; and
a base body made of ceramics,
the base body enclosing the heat-generator,
the heat-generator including two opposed portions arranged in juxtaposition and a connection portion for connecting the two opposed portions together in arcuate form,
the at least one recess of the heat-generator being located in at least one of the connection portion and the two opposed portions of the heat-generator and being filled with the base body, and
a dimension of the at least one recess in a longitudinal direction of the heat generator being greater than or equal to 1/10 and less than or equal to ½ of a length of the at least one of the connection portion and the two opposed portions.

2. The ceramic heater according to claim 1, wherein the at least one recess opens in a surface of the heat-generator which faces a surface of the base body.

3. The ceramic heater according to claim 1, wherein the heat-generator comprises a plurality of the recesses.

4. The ceramic heater according to claim 3, wherein
the heat-generator is a U-shaped heat-generator including the two opposed portions arranged in juxtaposition, and the plurality of recesses comprises one or more recesses located in each of the two opposed portions of the U-shaped heat-generator.

5. The ceramic heater according claim 1, wherein a depth of the at least one recess is a dimension corresponding to greater than or equal to 5% and less than or equal to 30%, of a diameter of the heat-generator.

* * * * *